United States Patent [19]

Emard

[11] Patent Number: 4,941,500

[45] Date of Patent: Jul. 17, 1990

[54] KNOCKDOWN CANOPY SHELTER

[76] Inventor: Michael J. Emard, 187 Oar La., Roseburg, Oreg. 97470

[21] Appl. No.: 219,069

[22] Filed: Jul. 13, 1988

Related U.S. Application Data

[63] Continuation of Ser. No. 920,652, Oct. 20, 1986, abandoned.

[51] Int. Cl.[5] ..... E04H 15/44; E04H 15/46; E04H 15/64

[52] U.S. Cl. ..... 135/106; 135/108; 135/119

[58] Field of Search ..... 135/106, 98, 100, 105, 135/107, 108

[56] References Cited

U.S. PATENT DOCUMENTS

| | | | |
|---|---|---|---|
| 1,068,352 | 7/1913 | Lyttle | 135/106 |
| 2,723,673 | 11/1955 | Call | 135/106 X |
| 3,186,420 | 6/1965 | Magee | 135/106 X |

*Primary Examiner*—Robert A. Hafer
*Assistant Examiner*—D. Neal Muir
*Attorney, Agent, or Firm*—H. Albert Richardson, Jr.

[57] ABSTRACT

A shelter having a frame of telescopic pole and arch assemblies with the latter joined at an apex of the shelter by insertion into a central connector. The canopy is fitted to the frame in a snug manner. Straps secure the corners of the canopy to each arch assembly and may be provided with hook and loop pieces to facilitate canopy attachment to the frame.

9 Claims, 1 Drawing Sheet

GS

KNOCKDOWN CANOPY SHELTER

This is a continuation of application Ser. No. 06/920,652 filed Oct. 20, 1986. now abandoned

BACKGROUND OF THE INVENTION

The present invention relates generally to knockdown shelters of the temporary type which have canopies and may be set up in a rapid manner for protection from the elements.

In common use today are temporary shelters such as those used at camp sites, fairs, flea markets and promotional shows of various types which shelters include canopies to protect the users and merchandise from the elements. Such shelters are quite costly for the reason they include a large array of tubular components which must be supported in place as by lines or alternatively embedded into the ground. Further, the large number of cross members add to the cost of the shelter as well as added effort in setting up and taking down the shelter. Further, known temporary shelters do not derive any reinforcing feature from the canvas or plastic canopy cover used therewith. A further drawback to known temporary shelters is the difficulty with which same are assembled which is complicated by the multitude of parts which must be assembled and thereafter separated at completion of shelter use.

Summary of the Present Invention

The present invention is embodied within a temporary shelter having telescopic pole and arch assemblies with a pliable cover or canopy snugly overlying and attached to the arch assemblies.

The shelter includes a tubular framework having pole assemblies at each corner which include upwardly extensible members each for inserted engagement with an arch assembly. The pole assemblies are flattened and curved at their lower ends to facilitate supported engagement with a ground surface. The main member of each pole assembly is of a length to substantially receive the upwardly extensible member of the pole assembly. Similarly each main member of the arch assemblies carries an upwardly extensible member which may be retracted into the main member to facilitate both storage and transport of the arch assemblies within a portable container. A connector is of spider configuration and into which are inserted the upper ends of the arch assembly members.

The pliable cover includes attachment means securing the cover to the frame in a secure manner whereby the cover will enhance the rigidity of the shelter. Such attachment means may include hook and loop fabric closure pieces. The telescopic pole and arch assemblies preferably include push button latching means to permit rapid shelter erection without tools.

Important objectives of the present shelter include the provision of a shelter with telescopic pole and arch assemblies permitting retraction of pole and arch members substantially into a main member of each assembly to greatly reduce the size of the container needed for storage or carrying of the disassembled shelter; the provision of a shelter having a pliable cover which fits in a snug manner over arch assemblies to contribute to shelter rigidity; the provision of a shelter utilizing cover attachment means permitting the user to attach the cover to the framework in a secure manner without the aid of tools; the provision of a shelter which in its knockdown form may be contained within a small, lightweight case or bag to render same highly portable; the provision of a shelter including a frame of tubular construction which tubing is of polygonal section significantly contributing to shelter rigidity.

DETAILED DESCRIPTION OF THE PREFERRED EMBODIMENTS

Figures 1, 2, 3, 4, 5, 6, 7:
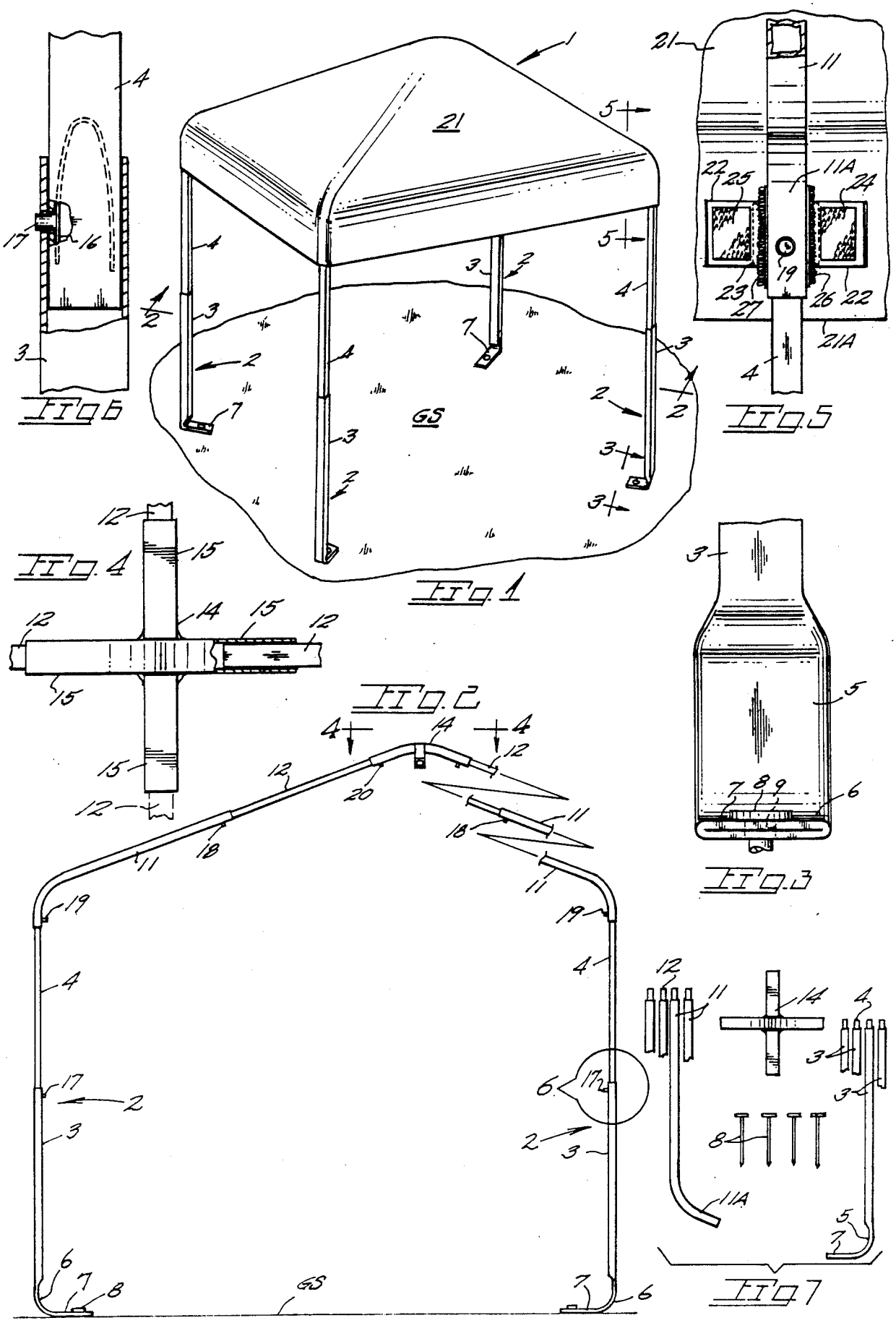
FIG. 1 is a perspective view of the present shelter.
FIG. 2 is a vertical sectional view taken along line 2—2 of FIG. 1 and with the cover removed.
FIG. 3 is an elevational view taken along line 3—3 of FIG. 1 showing a framed end segment of a pole assembly.
FIG. 4 is a plan view taken downwardly along line 4—4 of FIG. 2.
FIG. 5 is a vertical sectional view taken along line 5—5 of FIG. 1.
FIG. 6 is an enlarged view of that portion of FIG. 2 encircled at 6.
FIG. 7 is a composite view of the frame of the present shelter disassembled for stowage within a container.

With continuing attention to the drawings wherein applied reference numerals indicate parts similarly hereinafter identified, the reference numeral 1 indicates generally the present shelter in place on a natural or artificial ground surface GS with each pole assembly generally at 2 having a main member 3 and an upwardly extensible member 4. The lowermost end segment of each main member is (as best shown in FIG. 3) flattened at 5, curved at 6, to provide a foot 7. Foot 7 is apertured at 9 to receive a ground insertable spike 8.

Arch assemblies as typically shown in FIG. 2, include a main member 11 and an upwardly extensible member 12 which, as is the case with the pole assemblies, are preferably of square or otherwise polygonal in section tubing.

The extensible members 4 and 12 of the pole and arch assemblies may be retracted for stowage purposes within the main member of each assembly as shown in FIG. 7. Such retraction permits a relatively small container to be used for stowage and transport of the shelter. The linear length of the straight portions of main members 4 and 11 is approximately equal to the length of their respective extensible members 4 and 12. A vertical segment 11A of member 11 receives the upper end of pole assembly member 4.

At the apex of the shelter frame is a connector 14 having downwardly inclined arms 15 arranged in spider configuration for coupling to the uppermost member 12 of each arch assembly. The arms 15 serve to interconnect the arch assemblies and to angularly space same a desired number of degrees such as the ninety degree spacing shown in FIG. 4.

Latch means typically shown at 16 in FIG. 6 includes a leaf spring having a push button 17 thereon which projects through registerable openings in the main and the extensible members of the pole assemblies to maintain the main and extensible members thereof in extended relationship with one another. Similar latch means at 18 serves to lock the ends of arch assembly members 11 and 12 to one another. Like latch means at 19 serves to lock the upper ends of pole assembly members 4 to arch main members 11. Latch means at 20 lock the arch members 12 in inserted engagement with connector 14.

As shown in FIG. 5, a canopy at 21 is secured to the frame by canopy attachment means including a reinforcing strip 22 attached to the canopy as by stitching 23 (or other suitable means) adjacent the canopy lower edge at 21A. Strip 22 is provided with hook closure pieces 24 and 25 disposed on opposite ends of the strip 22 so as to be manually engageable with loop closure pieces 26 and 27 adhesively in place on sides of arch member 11. Accordingly, the canopy may be conveniently secured in a snug manner. Additionally, the canopy is sized so that when it is applied to the assembled frame it exerts inwardly directed forces on the frame to contribute to frame rigidity. While the hook and loop pieces provide the preferred closure means on strip 22, it is to be understood that other closure means could be utilized, such as buttons, snaps, ties, etc.

As shown in FIG. 7, the frame by reason of its telescopic pole and arch assemblies is of few components the assembly of which is self-evident to the user. The few lightweight components lend themselves to convenient transport within a hand carried case or bag. A popular use for such knockdown shelters is at flea markets whereat secondhand and hand crafted merchandise is sold.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

1. A knockdown portable shelter comprising:

a frame including a centrally located connector and a plurality of supporting members, each having a rafter portion attached and extending radially outward from the connector, a vertically oriented pole portion, an arcuate portion curving downward from the rafter portion to the pole portion and forming a smooth transition joining the rafter portion and pole portion and a foot formed from a curved lower segment of the pole portion;

a flexible canopy adapted to stretch over the rafter and arcuate portions of the supporting members and cooperating with those portions to enhance the structural rigidity of the frame; and means for securing the canopy to the frame;

whereby the canopy is tensioned by the movement of the pole portions radially outward from the connector due to the weight of the rafter portions and the connector.

2. The shelter of claim 1 wherein the pole portion is extensible to facilitate assembly and storage of the shelter.

3. The shelter of claim 1 wherein the pole portion is extensible to facilitate assembly and storage of the shelter and to permit the shelter to be leveled.

4. The shelter of claim 1 wherein the rafter and arcuate portions are joined to form an arch assembly.

5. The shelter of claim 2 wherein the rafter portion is telescopically extensible between storage and extended positions and includes means for securing the rafter portion in the extended position.

6. The shelter of claim 3 wherein the pole portion is telescopically extensible between storage and extended positions and includes means for securing the pole portion in the extended position.

7. The shelter of claim 4 further including means for latching the arch assembly and pole portion together.

8. The shelter of claim 1 wherein the connector includes an arm adapted to be joined to the rafter portion and including means to secure the rafter portion.

9. A knockdown portable shelter comprising:

a frame including, a centrally located cruciate shaped connector having a plurality of arms and a latching means associated with each arm;

a plurality of supporting members each having an extensible rafter portion attached to and extending radially outward from an associated arm of the connector and telescopically extensible between storage and extended positions, means for securing the rafter portion in the extended position, a plurality of vertically oriented pole portions telescopically extensible between storage and extended positions, means for securing the pole portions in the extended position, a plurality of arcuate portions, each curving downward from the rafter portion to the pole portion and forming a smooth transition the rafter portion and the pole portion and a plurality of feet, each formed from a curved lower segment of an associated pole portion and means for securing the pole and arcuate portions;

a flexible canopy adapted to stretch over the rafter and arcuate portions of the supporting members and cooperating with those portions to stabilize the shelter; and means for securing the canopy to the frame including cooperating hook and loop closure pieces attached to the canopy and a supporting member;

whereby the canopy is tensioned by movement of the pole portions radially outward from the connector due to the weight of the rafter portions and the connector.

* * * * *